US005424127A

United States Patent [19]

Dubois et al.

[11] Patent Number: 5,424,127

[45] Date of Patent: Jun. 13, 1995

[54] RIBBON FOR COATING BY TORCH SPRAYING AND ITS USE FOR DEPOSITING A QUASI-CRYSTALLINE PHASE ON A SUBSTRATE

[76] Inventors: Jean-Marie Dubois, 8 rue Docteur Zivré , F-54340 Pompey; Maurice Ducos, Route d'Uchaux, 89550 Mornaj; Robert Nury, 5 Rue des Remparts de l'Oulle, 84000 Avignon, all of France

[21] Appl. No.: 848,255

[22] Filed: Mar. 9, 1992

[30] Foreign Application Priority Data

Mar. 13, 1991 [FR] France ..... 91 03021

[51] Int. Cl.[6] ..... B32B 15/02; B32B 15/08

[52] U.S. Cl. ..... 428/373; 428/372; 428/374; 428/375; 428/383; 428/385; 428/650; 428/651; 428/652; 428/653; 219/146.1; 219/146.21; 219/146.23; 219/146.3; 219/146.31; 219/146.32; 219/146.41

[58] Field of Search ..... 219/146.1, 146.21, 146.23, 219/146.3, 146.31, 146.32, 146.41; 428/372, 373, 378, 375, 383, 385, 650, 651, 652, 653

[56] References Cited

U.S. PATENT DOCUMENTS

| | | | |
|---|---|---|---|
| 3,701,444 | 10/1972 | Clement et al. | 219/146 |
| 4,595,429 | 6/1987 | Le Caer et al. | 148/403 |
| 4,710,246 | 12/1987 | Le Caer et al. | 148/403 |

FOREIGN PATENT DOCUMENTS

| | | |
|---|---|---|
| 0100287 | 2/1984 | European Pat. Off. . |
| 0356287 | 2/1990 | European Pat. Off. . |
| 1443142 | 3/1965 | France . |
| 2177134 | 11/1973 | France . |
| 2042797 | 3/1971 | Germany . |

*Primary Examiner*—Patrick J. Ryan
*Assistant Examiner*—Richard P. Weisberger

[57] ABSTRACT

The invention relates to a ribbon or bead for coating by torch spraying and its use For depositing a quasi-crystalline phase on a substrate. The bead or ribbon (1) comprises a core having an organic binder and a powder or a mixture of powders able to Form a quasi-crystalline alloy, said core being surrounded by an organic material sheath. It makes it possible to deposit a quasi-crystalline alloy on a substrate whilst preparing said alloy in the flame (3) of a spraying apparatus and using commercial powders of the constituents of the quasi-crystalline alloy.

13 Claims, 5 Drawing Sheets

Figure 1:
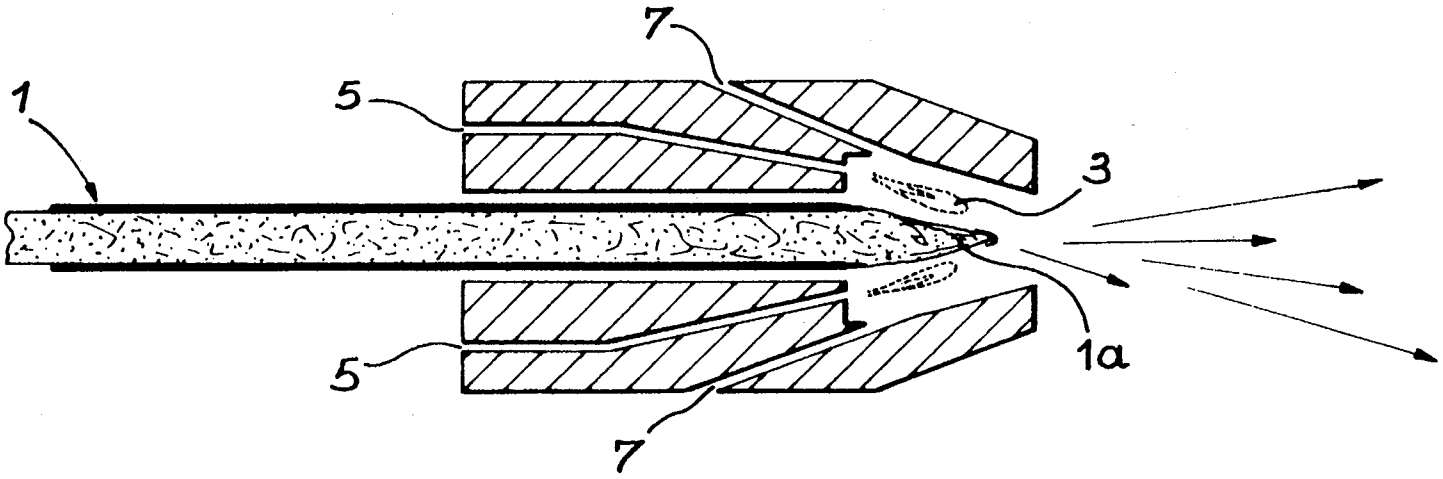

RIBBON FOR COATING BY TORCH SPRAYING AND ITS USE FOR DEPOSITING A QUASI-CRYSTALLINE PHASE ON A SUBSTRATE

The present-invention relates to a ribbon or bead for torch spray coating.

It more specifically relates to a ribbon making it possible to deposit surface quasi-crystalline alloy coatings on a substrate, i.e. of an alloy having a specific crystallographic structure in which there ace at least 30% by weight of a quasi-crystalline phase. Aluminium alloys of this type are e.g. described in EP-A-0 356 287.

In the present invention, the expression "quasi-crystalline phase" covers the following;

1) Phases having symmetries of rotation normally incompatible with the translation symmetry, i.e. symmetries with a rotation axis of order 5, 8, 10 and 12, said symmetries being detected by defraction of the radiation. Reference is e.g. made to the icosahedral phase of the point group m3 5 (cf. D. Shechtman, I. Blech, D. Gratias, J. W. Cahn, Metallic Phase with Long-Range Orientational Order and No Translational Symmetry, *Physical Review Letters,* Vol. 53, no. 20, 1984, pages 1951–1953) and the decagonal phase of the point group 10/mm (cf. L. Bendersky, Quasi-crystal with One Dimensional Translational Syrrmetry and a Tenfold Rotation Axis, *Physical Review Letters,* Vol. 55, no. 14, 1985, pages 1461–1463). The diffraction pattern of the X-rays of a true decagonal phase was published in "Diffraction approach to the structure of decagonal quasi-crystals, J. M. Dubois, C. Janat, J. Pannerlet, A. Planelli, *Physics Letters A* 117–8 (1986) 421–427".

2) The approximate phases or compounds, which are true crystals to the extent that their crystallographic structure remains compatible with the translation symmetry, but in the electron diffraction pattern have diffraction images, whose symmetry is close to the rotation axes 5, 8, 10 or 12.

Among these phases, reference is made in exemplified manner to the orthorhombic phase $O_1$ characterizing an aluminium alloy having the atomic composition $Al_{65}Cu_{20}Fe_{10}Cr_5$ belonging to the alloy compositions described in EP-A-0 356 287, whose lattice parameters are: $a_0^{(1)}=2.366$; $b_0^{(1)}=1.267$; $c_0^{(1)}=3.252$ in nanometers. This orthorhombic phase $\mathbf{0}_1$ is said to be approximate of the decagonal phase. It is so close to it that it is not possible to distinguish its X-ray diffraction pattern from that of the decagonal phase.

Reference can also be made to the rhombohedral phase of parameters $a_r=3.208$ nm, $\gamma=36^0$, present in alloys with a composition close to $Al_{64}Cu_{24}Fe_{12}$ in numbers of atoms (M. Audier and P. Guyot, Microcrystalline AlFeCu Phase of Pseudo Icosahedral Symmetry, in *Quasi-crystals,* eds. H. V. Jaric and S. Lundqvist, *World Scientific,* Singapore, 1989).

This phase is an approximate phase of the icosahedral phase.

Reference can also be made to the orthorhombic phases $O_2$ and $O_3$ with respective parameters $a_0^{(2)}=3.83$; $b_0^{(2)}=0.41$; $c_0^{(2)}=5.26$; and $a_0^{(3)}=3.25$; $b_0^{(3)}=0.41$; $c_0^{(3)}=9.8$ in nanometers, present in an alloy of composition $Al_{63}Cu_{17.5}Co_{17.5}Si_2$ in numbers of atoms or tile orthorhombic phase $\mathbf{0}_4$ of parameters $a_0^{(4)}=1.46$; $b_0^{(4)}=1.23$; $c_0^{(4)}=1.24$ in nanometers, which forms in the alloy of composition $Al_{63}Cu_8Fe_{12}Cr_{12}$ in numbers of atoms.

Reference can also be made to a cubic structure phase C, which is very frequently observed coexisting with two quasi-crystalline or approximate phases. This phase, which forms in certain alloys Al-Cu-Fe and Al-Cu-Fe-Cr consists of a superlattice, by chemical order effect of the alloy elements with respect to the aluminium sites, of a type Cs-cl structure phase and lattice parameter a=0.297 nm.

A diffraction pattern of this cubic phase has been published (C. Dong, J. H. Dubois, M. de Boissieu, C. Janot; Neutron diffraction study of the peritectic growth of the $Al_{65}Cu_{20}Fe_{15}$ icosahedral quasi-crystal; *J. Phys. Condensed Matter,* 2 (1990), 6339–6360) for a pure cubic phase sample of composition $Al_{65}Cu_{20}Fe_{15}$ in numbers of atoms.

Reference can also be made to a hexagonal structure phase H, which is directly derived from the phase C, as is demonstrated by the epitaxial relations observed by electron-microscopy between crystals of phases C and H and the simple relations linking the parameters of the crystalline lattices, $$a_H = 3\sqrt{2}\ \frac{a_1}{\sqrt{3}}$$

(to within 4.5%) and $$c_H = 3\sqrt{3}\ \frac{a}{1/2}$$

(to within 2.5%). This phase is isotypic of a hexagonal phase, designated $\phi$AlMn, designated in Al-Mn alloys containing 40% by weight Mn (M. A. Taylor, Intermetallic phases in the Aluminium-Manganese Binary System, *Acta Metallurgica* 8 (21960) 256).

The cubic phase, its superlattices and the phases derived therefrom constitute a class of approximate phases of quasi-crystalline phases of adjacent compositions.

Apart from their particular crystallographic structure, the alloys have quasi-crystalline phases with specific properties making them particularly interesting in the form of protective or hardening surface coatings on various substrates.

Thus, these alloys have good friction and hardness properties, as well as a good stability at temperatures exceeding 300° C. They can also be used in fields where a good resistance to abrasion, scratching, impact, erosion and cavitation are sought, together with a protection against oxidation and corrosion. Other properties such as e.g. their high electrical resistance or their heat conducting properties can be utilized in heating devices, including by electromagnetic coupling, or as a thermal barrier.

Hitherto, in order to use these quasi-crystalline alloys in coating form on a substrate, it was necessary to firstly prepare the quasi-crystalline alloy from different elements, followed by the formation of a powder of said alloy, either by grinding, or by atomization, and it was then projected or sprayed onto the substrate e.g. using a plasma torch.

Although this procedure is satisfactory, it suffers from the disadvantage of being onerous when the quasi-crystalline alloy quantities to be sprayed are small, because it is necessary to have a powder of the said alloy which has been produced beforehand, whereas numerous quasi-crystalline alloy compositions can be envisaged.

The present invention relates to a bead or ribbon usable for forming by torch spraying quasi-crystalline alloy coatings making it possible to avoid the prior operation of producing the alloy and suitable for forming quasi-crystalline alloy coatings of any random prefixed composition According to the invention, the torch spraying coating ribbon consists of a core incorporating an organic binder and a powder or powder mixture able to form a quasi-crystalline alloy, said core being surrounded by an organic material sheath.

Advantageously, the ribbon core also contains a mineral of inorganic binder making it possible, during the spraying operation, to bond together the powder particles until they have been completely fused. As an example of the mineral binder, reference can be made to refractory oxide fibers such as alumina fibers.

The said ribbon structure is very advantageous, because it is possible to appropriately choose the organic binder and the material for the sheath with a view to obtaining a flexible ribbon, which makes it possible to continuously supply a spraying torch.

Moreover, as it is possible to use in the ribbon a powder mixture able to form a quasi-crystalline alloy, any random alloy composition can be formed by appropriately dosing the quantities of powders placed in the core.

Thus, with the ribbon according to the invention, the production of quasi-crystalline alloy coatings having varied compositions is no longer onerous and can be carried out as required.

In the said ribbon, the organic binder and the organic material of the sheath are chosen so as to be easily eliminatable in the torch during the spraying operation, e.g. by combustion.

Examples of the organic binder and the organic material which can be used are cellulose derivatives such as methyl cellulose, hydroxymethyl cellulose, hydroxyethyl methyl cellulose and carboxymethyl cellulose, as well as polymers such as polyvinyl alcohol and polymethacrylic acid.

In certain cases, the core of the ribbon incorporates water and/or an organic plasticizer, which can easily be eliminated during the spraying operation, e.g. with specific properties makincalcination.

Examples of the plasticizer are glycerol, ethglycol and triethanol amine. The organic binder weight proportion in the core does not generally exceed 4%. When the core contains a mineral binder, its content is preferably below 6% by weight.

According to a first embodiment of the ribbon according to the invention, the core comprises a single powder able to form a quasi-crystalline alloy, whereby said powder can be an alloy powder of composition:

$$Al_aX_b(BC)_cM_dN_eI_f$$

in which

X represents at least one element chosen from among Cu and Co,

M represents one or more elements from the group including Fe, Cr, Mn, Ni, Ru, Os, Mo, V, Mg, Zn, Ga and Pd, N represents one or more elements of the group including W, Ti, Zr, Hf, Rh, Nb, Ta, Y, Si, Ge and rare earths, I represents one or more alloy impurities, a, b, c,d, e and f represent atomic percentages such that they satisfy the following relations:

$48 \leqq a < 92$
$0 < b \leqq 30$
$0 \leqq c \leqq 5$
$8 \leqq d \leqq 30$
$0 \leqq e \leqq 4$
$0 \leqq f \leqq 2$
$a+b+c+d+e+f=100$
$b+d+3 \leqq 45$.

This embodiment of the ribbon according to the invention is usable when the quasi-crystalline alloy quantities to be sprayed are significant and justify the prior preparation of an alloy powder.

However, in this case, the torch spraying operation generally leads to the production of a quasi-crystalline alloy coating not having precisely the same composition as the alloy of the powder, but the properties of a quasi-crystalline deposit are maintained.

According to a second embodiment of the ribbon according Lo the invention, the core comprises a mixture of powders able Lo form a quasi-crystalline alloy, e.g. a mixture of powders of the elements Al, X, B, C, M, N and I, with X representing at least one element chosen from among Cu and Co, M representing one or more elements of the group consisting of Fe, Cr, Mn, Ni, Ru, Os, Mo, V, g, Zn, Ga and Pd, N representing one or more elements from the group including W, Ti, Zr, Hf, Rh, Nb, Ta, Y, Si, Ge and rare earths and I representing one or more alloy impurities, in proportions such that the mixture of powders corresponds to the composition of formula:

$$Al_aX_b(B,C)_cM_dN_eI_f$$

in which X, M, N and I have the meanings given hereinbefore and a, b, c, d, e and f represent atomic percentages satisfying the following relations:

$48 \leqq a < 92$
$0 < b \leqq 30$
$0 \leqq c \leqq 5$
$8 \leqq d \leqq 30$
$0 \leqq e \leqq 4$
$0 \leqq f \leqq 2$
$a+b+c+d+e+f=100$
$b+d+e \leqq 45$.

This second embodiment of the ribbon according to the invention is much more interesting, because it makes it easy to produce ribbons for the spraying of quasi-crystalline alloys having very varied compositions. Thus, it is sufficient to use in this case commercially available powders corresponding to the desired elements for producing the core of the ribbon and to carefully dose these powders in order to obtain the desired alloy composition.

In the second embodiment of the ribbon according to the invention, it is possible to also supply at least two elements of the alloy in the form of a combination thereof, e.g. in the form of a prealloyed powder.

The spraying ribbons described hereinbefore can be prepared by conventional processes and in particular by co-spinning two pastes, whereof one constitutes the core and the other is to form the outer sheath. A process of this type is more particularly described in FR-A-1 449 142.

According to a variant of the invention, the torch spraying coating ribbon comprises a core constituted by a mixture of inorganic powders and an inorganic material sheath, the powders of the mixture and the sheath being constituted by one or more elements chosen from among Al, X, B, C, M. N and I, with X representing at least one element chosen from among Cu and Co, M representing one or more elements from the group including Fe, Cr, Hn, Ni, Ru, Os, Ho, V, Mg, Zn, Ga and Pd, N representing one or more elements from the group including W, Ti, Zr, Hf, Rh, Nb, Ta, Y, Si, Ge and the rare earths and I representing one or more alloy impurities, in proportion such that the entity (sheath +powder mixture) corresponds to a quasi-crystalline alloy composition.

In this case, the quasi-crystalline alloy composition can also comply with the formula $Al_aX_b(B,C)_cM_dN_eI_f$, in which X, H, N, I, a, b, c, d, e and f have the meanings given hereinbefore.

In this variant of the invention, it is in particular possible to produce the sheath from steel. Al, Cu or Ni and thus obtain a flexible lined wire suitable for supplying a torch.

The present invention also relates to a process for depositing on a substrate a quasi-crystalline alloy coating, which consists of using an oxidizing - gas flame and/or electric arc or plasma spraying gun and supplying the latter by means of a spraying ribbon of the type described hereinbefore, so as to spray onto the substrate the quasi-crystalline alloy obtained by reaction in the flame of the constituents of the ribbon.

The spraying ribbons according to the invention are very advantageous in this process, because they make it possible to introduce into the heart of the flame a thermal spraying device, all the constituent elements of a quasi-crystalline alloy and to ensure a residence time of these elements within the flame adequate for ensuring a complete reaction and the formation of a quasi-crystalline alloy.

The thus prepared quasi-crystalline alloy is atomized by supply gases of the spraying apparatus in the form of finely divided droplets onto the substrate. When the core of the ribbon also incorporates mineral fibers. e.g. alumina fibers, the latter are also sprayed into the coating formed on the substrate. However, the organic binder .and the sheath of the ribbon are vaporized during spraying and do not intervene either in the alloy formation reactions, or in the coating.

This manner of spraying quasi-crystalline alloys offers several advantages compared with the prior art thermal spraying methods, which use powder torches. Firstly, it is possible to obviate the operation of atomizing a quasi-crystalline powder with a specific composition by replacing it by a much simpler operation consisting of mixing readily available powders for the formation of a paste. It also makes it possible to use simpler spraying devices which have a very good spread. Finally, it offers the possibility of composing at random the mixture of powders and consequently obtain any desired alloy composition.

The quasi-crystalline alloy deposits obtained .by this process have an increased hardness and improved friction coefficients compared with numerous prior art deposits. In addition, these quasi-crystalline deposits are perfectly indicated in all tribological applications consisting of reinforcing a metal surface with an alloy based on iron, aluminium, copper or nickel.

It is also possible to use the quasi-crystalline deposits according to the invention for producing metallic underlayers for metal—metal, metal—ceramic or metal—oxide bonds, which have a remarkable adhesion force. These quasi-crystalline deposits can also be used as binding layers between a ceramic layer and an oxide layer.

The invention is described in greater detail hereinafter relative to non-limitative embodiments and the attached drawings, wherein show:

FIG. 1 A diagrammatic representation of a spraying apparatus usable in the invention.

FIGS. 2 to 16 X-ray diffraction patterns characterizing the quasi-crystalline alloys obtained by spraying ribbons according to the invention.

FIG. 1 very diagrammatically shows the end of a spraying gun using the spraying ribbon or bead according to the invention.

Within the said gun, the spraying ribbon 1 according to the invention is introduced into an oxidizing gas flame 3 supplied with combustion gas by channels 5. In said flame 3, the end la of the ribbon which is melted by the flame, reacts in said flame to form the quasi-crystalline alloy and the liquid alloy obtained is atomized by a pressurized gas, e.g. air, introduced by the pipes 7 in the form of droplets and which are sprayed onto a substrate.

In a gun of this type, the combustion gas can be a mixture of hydrogen, acetylene or propane with oxygen and the gas flowing in the pipes 7 can be a pressurized air jet.

The following examples illustrate the production of spraying ribbons according to the invention and their use for producing quasi-crystalline alloy deposits on mild steel substrates.

EXAMPLE 1

This example makes use of the first embodiment of the invention for preparing a spraying ribbon from a quasi-crystalline alloy powder obtained by grinding, in a mixer having concentric rolls made from carbon steel, small ingots of a quasi-crystalline alloy with the following atomic composition:

$$Al_{62.8}Cu_{19.5}Fe_{8.5}Cr_{9.1}Mn_{0.1}$$

For preparing the ribbon, intimate mixing takes place in a mixer of 96% by weight of the alloy powder obtained by grinding and having a grain size from 20 to 150 μm, 4% boehmite fibers and 4% organic binder constituted by hydroxyethyl methyl cellulose.

On the basis of the mixture obtained, preparation takes place of a first paste by adding an adequate water quantity, followed by vigorous mixing for 1 hour. This is followed by the preparation of a second paste to be used in forming the sheath by mixing the same organic binder as used for preparing the first paste with an adequate quantity of water.

This is followed by a co-spinning of said two pastes in a press in order to obtain a flexible ribbon having an external diameter of 4.75 mm, a length of 60 m and a sheath thickness of 0.012 mm.

Figure 2:
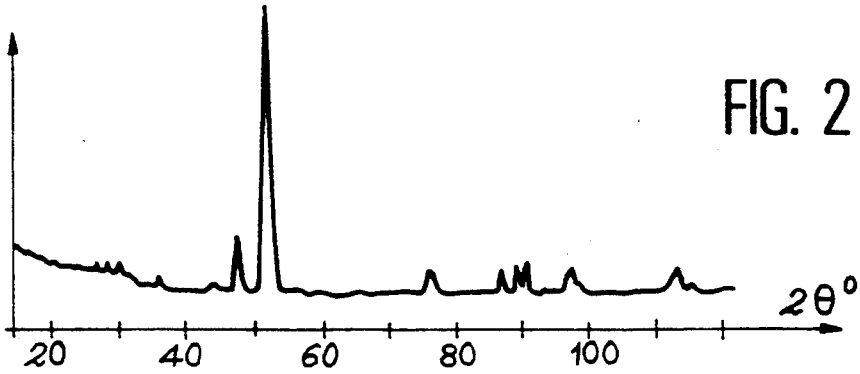

FIG. 2 shows the X-ray diffraction pattern at a wavelength of 0.17889 nm of the quasi-crystalline alloy of the starting powder. This pattern shows the presence of the decagonal phases C, $O_1$ and $O_3$.

EXAMPLE 2

This example follows the same operating procedure as in example 1 for preparing 8 spraying ribbon from a quasi-crystalline alloy powder of formula $Al_{65.2}Cu_{18.4}Fe_{8.2}Cr_{8.2}$ but in this case, the starting product is constituted by a powder obtained by atomizing an argon jet and having 8 grain size distribution from 20 to 150 μm.

Figure 3:
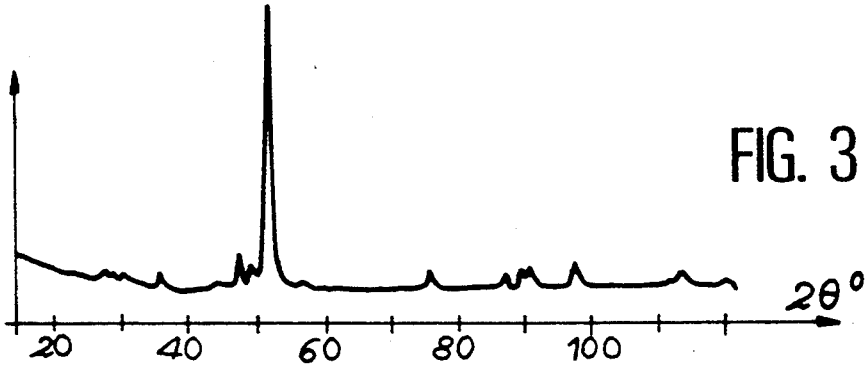

The X-ray diffraction pattern of the starting alloy is given in FIG. 3. It reveals the presence in the starting powder of decagonal phases C, $O_1$ and $O_3$.

EXAMPLE 3

This example adopts the same operating procedure as in example 2 for preparing a spraying ribbon according to the first embodiment of the invention, but starting with 8 quasi-crystalline alloy powder of formula $Al_{70}Cu_9Fe_{10.5}Cr_{10.5}$ also obtained by atomization and having a grain size distribution from 20 to 150 μm.

Figure 4:
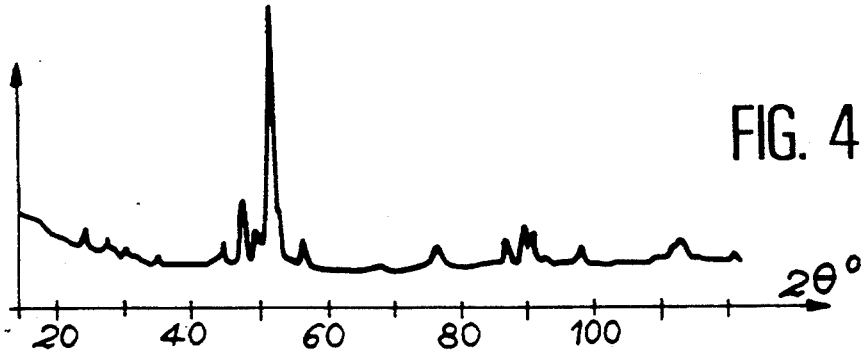

FIG. 4 is the X-ray diffraction pattern of the starting alloy and shows the presence of decagonal phases C, $O_1$ and $O_3$.

EXAMPLES 4 TO 9

These examples use the second embodiment of the ribbon according to the invention, i.e. the ribbon core is prepared from powders of constituents taken separately and having the characteristics given in the following table 1.

| Element | Shape of Powder Grains | Grain Size Range (μm–μm) |
|---|---|---|
| Al | Irregular | 45–150 |
| B | Spherical | 10–80 |
| Co | Spherical | 45–90 |
| Cr | Irregular | 22–45 |
| Cu | Rounded | 45–150 |
| Fe | Irregular/Porous | 25–110 |
| Ni | Spherical | 45–90 |

For these preparations the same operating procedure as in example 1 is used, except that the first paste is prepared from a mixture of powders of different constituents in proportions such that they correspond to the atomic composition given in table 2, the weight percentages of powder, fibers and binder being the same as in example 1. The finely divided aluminium powder was firstly coated with stearic acid to avoid its oxidation at ambient temperature. The ribbons obtained also have an external diameter of 4.75 mm and a sheath thickness of 0.12 mm.

EXAMPLE 10

In this example preparation takes place of spraying ribbon corresponding to the variant of the invention. In this case, use is made of a 18 mm wide, 0.3 mm thick carbon steel sheath and to this steel strip is applied a mixture of powders of aluminium, copper, iron and chromium with the characteristics given in table 1 for obtaining a mixture in which the powder+sheath together corresponds to the composition $Al_{65.3}Cu_{18.4}Fe_{8.2}Cr_{8.1}$.

The strip is then rolled by mechanical shaping in order to obtain a wire having an external diameter of

EXAMPLES 11 TO 29

These examples make use of the spraying ribbons prepared in examples 1 to 10 for producing quasi-crystalline alloy coatings using a wire torch like that shown in FIG. 1 and operating under the following conditions:

- ribbon advance speed 300 or 1600 mm/min, which leads to powder weight supply levels for the torch close to 600 g/h and 3.1 kg/h respectively;
- combustion gas: hydrogen, acetylene or propane with oxygen;
- combustion/$O_2$ gas flow rates, varying as a function of the examples;
- distance from the gun nozzle to the substrate: 80 or 150 mm.

In all cases, the substrate is constituted by square mild steel plates with a side length of 50 mm and a thickness of 2 mm and which have previously been cleaned with a corundum jet. The deposition conditions used for each example are given in table 3.

Following said deposition, the coatings obtained are inspected by X-ray diffraction at a wavelength of 0.17889 nm in order to ensure that they correspond to quasi-crystalline alloys.

Table 3 gives the quasi-crystalline phases identified in each example and their weight fractions in the coating without taking account of the alumina deposited from the ribbon. This table makes it clear that the spraying ribbons according to the invention easily make it possible to obtain quasi-crystalline alloy deposits.

FIGS. 5 to 12 are X-ray diffraction patterns obtained with the deposits of examples 11, 12, 14 to 18 and 20.

Figure 5:
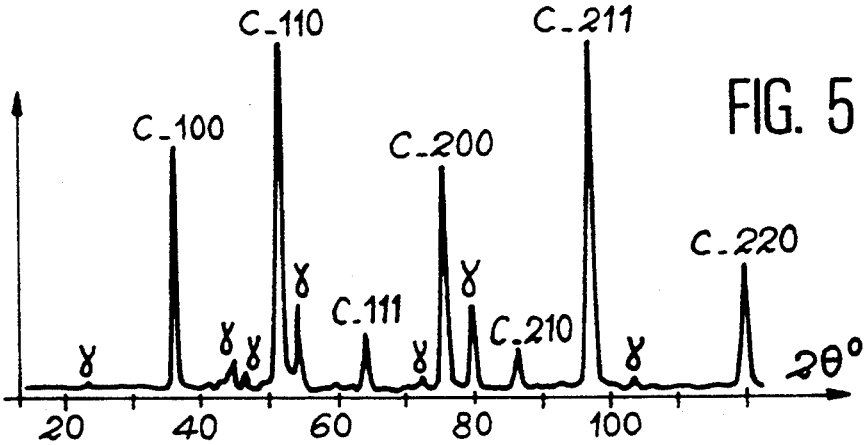

FIG. 5, which relates to example 11, shows that the pattern is characteristic of the cubic phase C, whose diffraction bands are designated C-100, C-110, C-111, C-200, C-210 and C-220, the figures following the letter C corresponding to the Miller indices of the bands. The other bands, designated gamma, correspond to the aluminium oxide introduced into the deposit from the alumina fibers present in the ribbon core.

Figure 11:
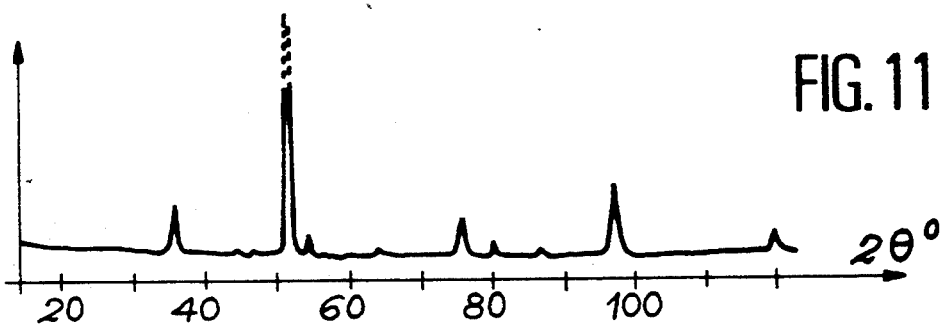
Figure 12:
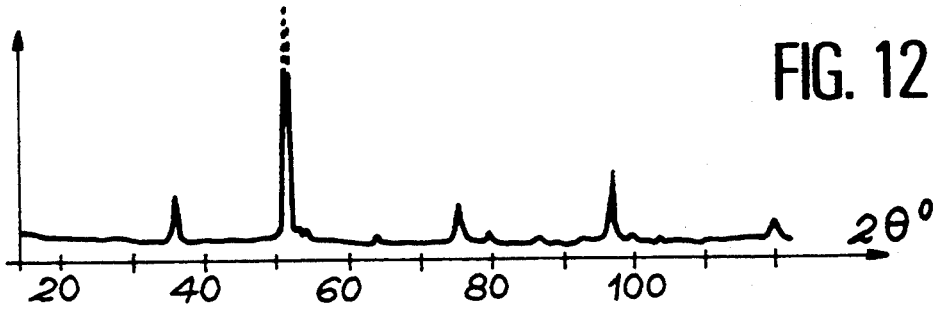
Figure 13:
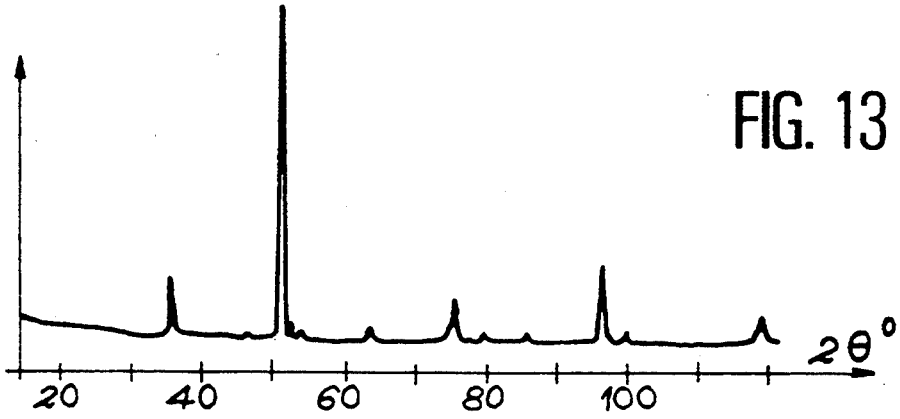
Figure 14:
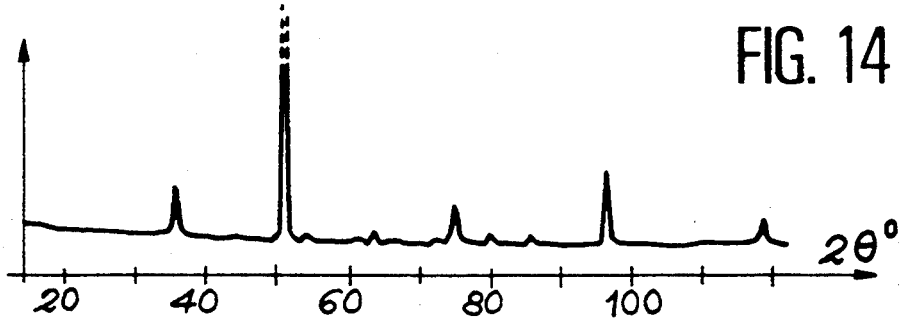
Figure 15:
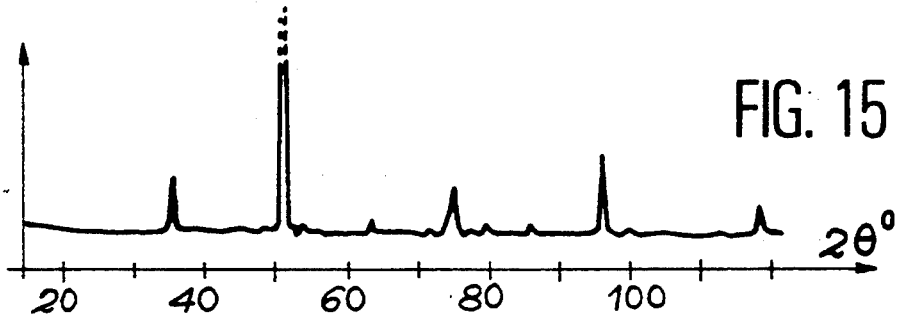
Figure 16:
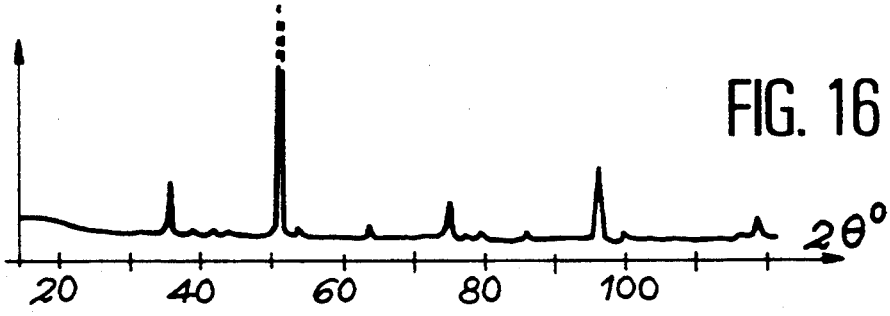

FIGS. 6 to 12, whose scales are not identical to those of FIG. 5, show the X-ray diffraction patterns deposits obtained in the following examples:

example 12 (FIG. 6)
example 14 (FIG. 7),
example 15 (FIG. 8),
example 16 (FIG. 9)
example 17 (FIG. 10)
example 18 (FIG. 11)
example 20 (FIG. 12).

Figure 6:
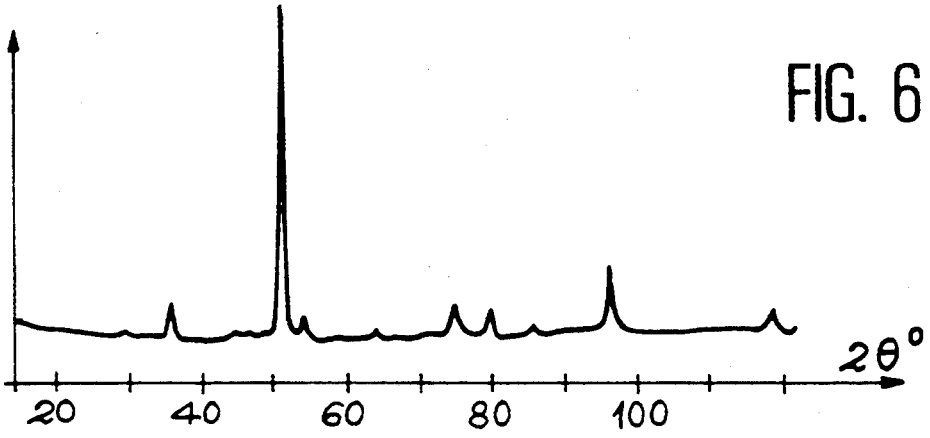
Figure 7:
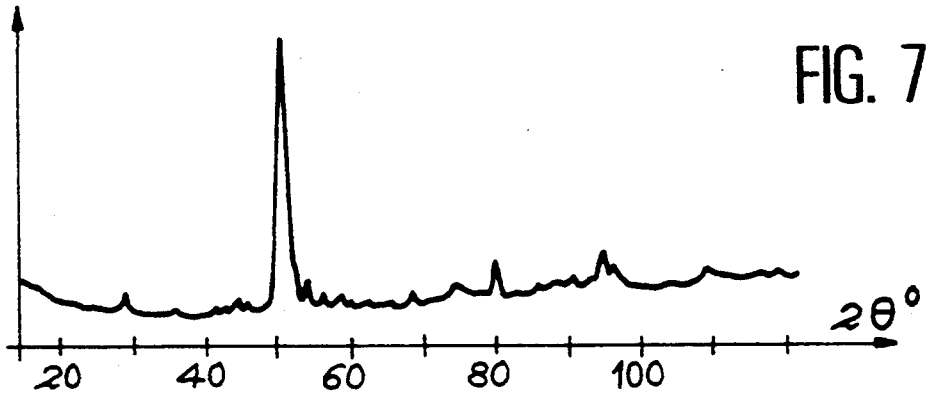
Figure 8:
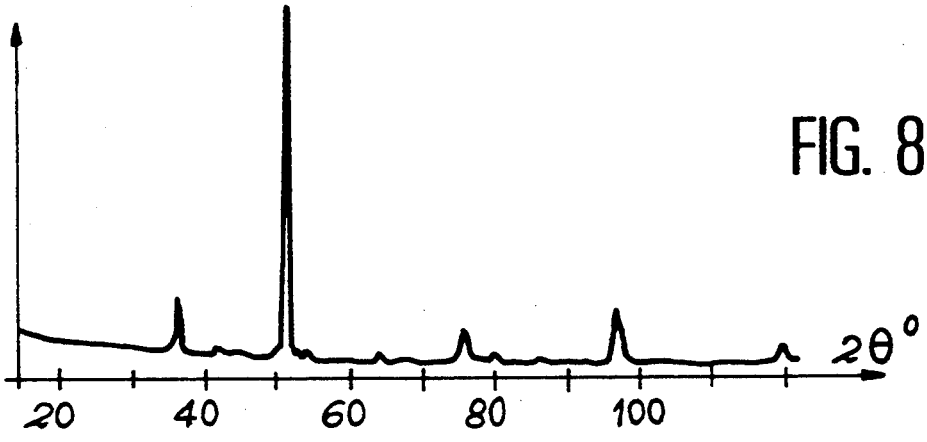
Figure 9:
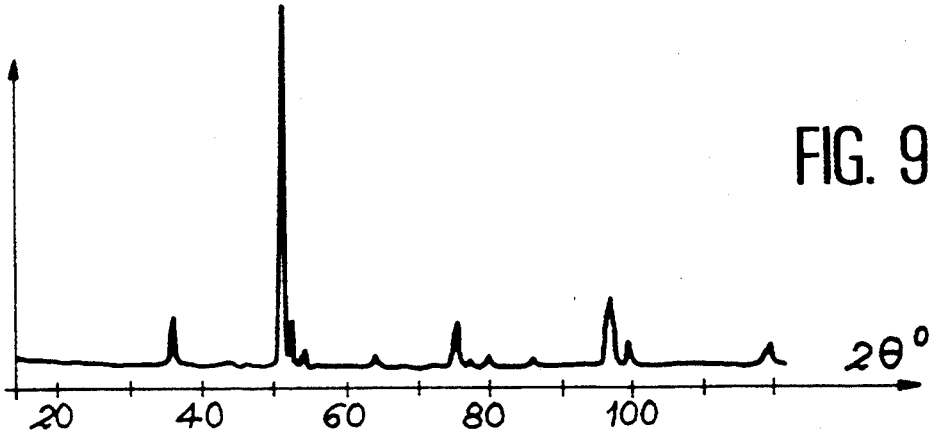
Figure 10:
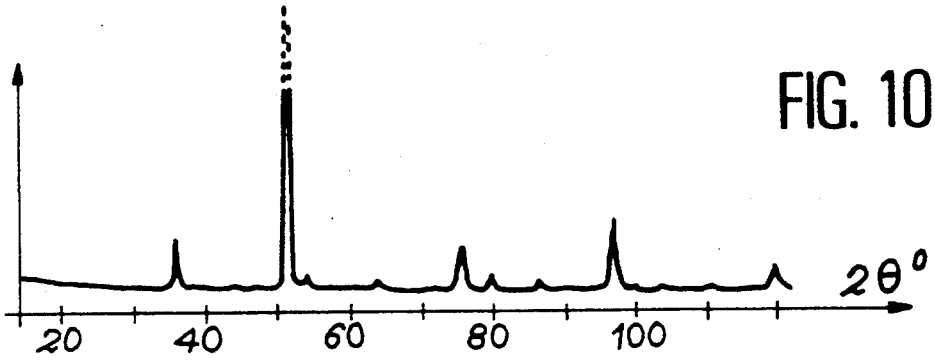

Thus the patterns of FIGS. 6, 8, 9 and 11 are also characteristic of the C crystalline phase, FIG. 7 is characteristic of the C+H+$O_1$ crystalline phases and FIGS. 10 and 12 are characteristic of the C+H crystalline phases.

On comparing the X-ray diffraction patterns of figs, 2, 3 and 4 with those of FIGS. 5, 6 and 7 respectively, it can be seen that the latter patterns differ slightly, but they correspond to a quasi-crystalline alloy differing only slightly from the starting alloy.

In table 3 it is also possible to see that the quasi-crystalline phase level produced and, to a considerable extent, the nature of these phases is not dependent on the deposition parameters, which ensures that the process according to the invention can be easily performed.

EXAMPLE 30

This example serves to prove the thermal stability of the deposits obtained with the ribbons according to the invention.

To this end, these deposits are exposed to two types of heat treatment, namely keeping isothermally under a secondary vacuum in a sealed quartz bulb, or keeping isothermally in air. These treatments are applied to the samples in the form of 1/33 5 cm plates, which are cut with a diamond saw from mild steel substrates coated with the quasi-crystalline alloy obtained in examples 11, 15 and 20.

At the end of each heat treatment the sample is cooled to ambient temperature by natural convection in air. It is then examined by X-ray diffraction. As a result of the wavelength used (0.17889 nm), this procedure makes it possible to study the coating materials over a depth of a few micrometers from the exposed surface, so as to permit the detection of modifications due to the surface oxidation.

The results obtained revealed that the quasi-crystalline coatings obtained from the ribbons according to the invention were particularly stable.

The treatment conditions and the tested samples are given in table 4.

FIGS. 13 to 16 are X-ray diffraction patterns obtained on samples which have undergone the heat treatment. On comparing the diffraction patterns of FIGS. 13, 14, 15 and 16 respectively with those of FIGS. 5, 8 and 12, it can be seen that no modification has taken place.

Thus, the quasi-crystalline coatings obtained from the spraying ribbons according to the invention are particularly stable. It was not possible to detect after the treatment any structural change, which would have been revealed by relative intensity changes of the diffraction peaks or by the appearance of new bands. In the same way, keeping hot in air, including up to 750° C., did not lead to an increase in the intensity of the bands corresponding to alumina and did not lead to the appearance of characteristic bands of another oxide.

The coating materials produced from the ribbons according to the invention are consequently able to provide a very adequate resistance to oxidation, which is very interesting when coupled with their high thermal stability.

EXAMPLE 36

This example is used for determining the hardness of the quasi-crystalline alloy coatings obtained in example 12, 14 and 24 to 28.

To this end, cutting took place with the diamond saw of part of the coated substrate plates obtained in these examples in order to take a $40\times10$ mm$^2$ testpiece. The latter was then coated with a resin for metallographic use, then finely polished for observation with an optical microscope. The testpiece was placed in the coating in such a way that its polished section forms an angle of 40 to 50° with its surface.

The Vickers hardness was then measured on this polished testpiece section using a Volpert microdurometer operated by a 400 g load. The mean values obtained from at least 10 impressions per deposit are given in table 5.

For comparison purposes, this table also gives the Vickers hardness values measured under a 400 g load for quasi-crystalline alloys of the same composition but in ingot form. This comparison confirms that the spraying ribbons according to the invention lead to hard coatings, equivalent to those of alloys produced in ingot form and no matter what spraying ribbon is used, because the hardnesses are equally good when using a ribbon having a core constituted by a mixture of powders of elements of the quasi-crystalline alloy.

EXAMPLE 37

In this example characterization takes place of the tribological properties of the coatings obtained from the ribbons according to the invention by determining their friction coefficient p, which is equal to $F_t(N)/F_n(N)$, i.e.. to the ratio between the resistance force $F_t$ in advance of an indentor to which is applied a normal force $F_n$, both being expressed in Newtons.

In order to measure this coefficient, use is made of a CSEM tester (of the pin/dis type) equipped either with a Vickers diamond indentor, or with a diameter 1.58 mm 100C6 Brinell tool steel ball. Horizontal positioning on the tester takes place of a specimen of the steel substrates coated with the quasi-crystalline alloy obtained in examples 12, 14 and 24 to 28 and they are rotated at a uniform speed of one r.p.m. The indentor is applied with a constant normal force $F_n$ of 5 Newtons and in the coating is made a circular groove with a diameter of 18 mm (in the case of the diamond indentor) or 25 mm (in the case of the Brinell steel ball). In the case of the diamond, only the first groove is retained.

The friction coefficient is determined on the basis of the measurement of the resistance force, measured tangentially to the indentor trajectory and which therefore consists of the cumulative effects of the grooving of the coating and of the true friction force.

In the case of the Brinell ball, f is measured during the first scratch or groove and the test is then continued for 5 supplementary revolutions in such a way that the steel indentor ends the hollowing out of its groove in the coating. The friction coefficient is then measured during the fifth revolution, which then excludes the contribution to the friction resulting from the hollowing out of the groove. The friction coefficient also integrates the effect which may result from material transfer from the coating to the indentor, because a new ball is used for each test.

It was observed that this effect is not systematically observed during an examination of the surface of the ball by optical microscopy following the test.

However, a significant increase in the friction force is noted when there is a significant deposit porosity. Thus, in this case, the indentor displacement leads to the compacting of the underlying coating material and consequently increases, during the first passages, the contact surface between the indentor and the material and therefore the resistance force to the indentor displacement.

The results obtained are given in table 6. The latter also gives values the of the friction coefficients obtained in the case of two 1 mm thick deposits produced on mild steel substrates using a plasma torch with the initial quasi-crystalline alloy powders used in examples 2 and 3.

These results show that the friction coefficients obtained by spraying the coatings from the ribbons according to the invention are equivalent to the friction coefficients obtained when the coating is made by the deposition of the alloy using a plasma torch.

EXAMPLE 38

In this example determination takes place of the thermal and electrical properties of the quasi-crystalline alloy coating obtained in example 12, which has a thickness of 3 mm. Firstly evaluation takes place of the thermal conductivity using a thermal diffusivity measurement arrangement.

For the purposes of this test, the coating is firstly separated from the substrate by mechanically machining the latter, followed by the irradiation of a diameter 10 mm, 3 mm thick cylindrical specimen taken from the sample using a laser beam having an energy of 20 J and with a pulse duration of $5.10^{-6}$s. Detection takes place of the temperature rise on the opposite face of the specimen as a function of time using an infrared sensor. From this measurement is then deduced the thermal diffusivity, which is linked with the thermal conductivity K by the relation $K=\alpha C_p d$, in $C_p$ is the specific heat of the alloy and d its specific gravity.

The specific heat was measured at ambient temperature with the aid of a SETARAH scanning calorimeter and the specific gravity was obtained by weighing, related to the specimen volume. The following results were obtained:

$\alpha=1.3.10^{-6}m^2/s$ $C_p=600$ J/kgK $d=4300$ kg/m$^3$

K=3.3 W/mK.

In order to carry out the electrical measurements from the quasi-crystalline alloy coated specimen of example 12 separated from its substrate was cut a 1×1×10 mm testpiece using an electrolytic saw. The electrical resistivity of this testpiece was then measured at ambient temperature using the so-called 4 point method, a constant measuring current of 10 mA and by measuring the voltage at the terminals of the internal electrodes with a very accurate nanovoltmeter. This gave an electrical resistivity of 3 ohm/meter, i.e. an electrical conductivity of 0.33 $ohm^{-1}m^{-1}$.

The thermal conductivity values on the one hand and the electrical conductivity values on the other are particularly low for a material having essentially metallic characteristics.

In addition, the quasi-crystalline alloy deposits of the present invention are particularly interesting for numerous applications, e.g. for producing thermal barriers, insulation, heating by the Joule effect or heating by electromagnetic induction.

TABLE 2

| Example | Atomic Composition of the Powder Mixture |
|---|---|
| 4 | $Al_{65}Cu_{20}Fe_{15}$ |
| 5 | $Al_{63.5}Cu_{24}Fe_{12.5}$ |
| 6 | $Al_{70.9}Cu_9B_{0.1}Fe_{10}Cr_{10}$ |
| 7 | $Al_{70}Co_{10}Fe_{13}Cr_7$ |
| 8 | $Al_{66}Co_{18}Fe_8Cr_8$ |
| 9 | $Al_{70}Co_{15}Ni_{15}$ |

TABLE 3

| Ex. | Ribbon of ex. | Atomic Composition of the Starting Alloy | Ribbon Advance Speed (mm/min) | Combustion Gas | Gas/O2 Flow Rates (1/h)/(1/h) | Nozzle-substrate Distance (mm) | Identified Quasi-Crystalline Phases | % by Weight of the Quasi-Crystalline Phases | X-ray Diffraction |
|---|---|---|---|---|---|---|---|---|---|
| 11 | 1 | $Al_{62.8}Cu_{19.5}Fe_{8.5}Cr_{9.1}Mn_{0.1}$ | 300 | acetylene | 1330/3360 | 100 | C | >95% | FIG. 5 |
| 12 | 2 | $Al_{65.2}Cu_{18.4}Fe_{8.2}Cr_{8.2}$ | 300 | acetylene | 1330/3000 | 100 | C | >95% | FIG. 6 |
| 13 | 3 | $Al_{70}Cu_9Fe_{10.5}$ | 300 | acetylene | 1330/3000 | 80 | C + H + $O_1$ + $O_3$ | >95% | FIG. 7 |
| 14 | 3 | $Cr_{10.5}$ | 600 | acetylene | 1330/3000 | 80 | C + H + $O_1$ | >95% | |
| 15 | 4 | $Al_{65}Cu_{20}Fe_{15}$ | 300 | acetylene | 1330/3000 | 100 | C | >95% | FIG. 8 |
| 16 | 5 | | 600 | acetylene | 1330/3000 | 150 | C | >98% | FIG. 9 |
| 17 | 5 | | 300 | propane | 890/4630 | 100 | C + H | >95% | FIG. 10 |
| 18 | 5 | | 300 | hydrogen | 2820/1500 | 80 | C | >95% | FIG. 11 |
| 19 | 5 | $Al_{63.5}Cu_{24}$ | 600 | propane | 890/4200 | 150 | C | >95% | FIG. 12 |
| 20 | 5 | $Fe_{12.5}$ | 300 | acetylene | 1330/3200 | 100 | C + H | >98% | |
| 21 | 5 | | 600 | acetylene | 1330/3200 | 150 | C + H | >98% | |
| 22 | 5 | | 300 | propane | 890/4400 | 80 | C + H | >98% | |
| 23 | 5 | | 300 | hydrogen | 2820/1380 | 80 | C + H + $O_1$ | >95% | |
| 24 | 5 | | 300 | acetylene | 1330/3360 | 80 | C + H | >95% | |
| 25 | 6 | $Al_{70.9}Cu_9B_{0.1}Fe_{10}Cr_{10}$ | 300 | acetylene | 1330/3000 | 100 | C + H + $O_1$ + $O_3$ | >90% | |
| 26 | 7 | $Al_{70}Co_{10}Fe_{13}Cr_{17}$ | 300 | acetylene | 1330/3000 | 100 | C + H + $O_1$ | >95% | |
| 27 | 8 | $Al_{66}Co_{18}Fe_8Cr_8$ | 300 | acetylene | 1330/3000 | 100 | C + H + $O_1$ | >95% | |
| 28 | 9 | $Al_{70}Co_{15}Ni_{15}$ | 300 | acetylene | 1330/3000 | 100 | C + H + decagonal | >90% | |
| 29 | 10 | $Al_{65.3}Co_{18.4}Fe_{8.2}Cr_{8.1}$ | 300 | acetylene | 1330/3000 | 100 | C | >95% | |

TABLE 4

| Ex. | Specimen | Maintenance Temperature | Maintenance Time (hours) | Conditions | X-ray Diffraction (FIG.) |
|---|---|---|---|---|---|
| 30 | of ex. 11 | 550° C. | 20 | vacuum | — |
| 31 | | 750° C. | 30[1)] | vacuum[1)] | 13 |
| 32 | of ex. 15 | 800° C. | 30 | vacuum | 14 |
| 33 | of ex. 20 | 550° C. | 24 | vacuum | 15 |
| 34 | of ex. 20 | 550° C. | 0,5 | air | — |
| 35 | " | 750° C.[2)] | 3[2)] | air[2)] | 16 |

[1)]After the heat treatment of example 30.

[2)]After the heat treatment of example 34.

TABLE 5

| Coating of ex. | Invention Hv400 | Prior Art Alloy HV400 |
|---|---|---|
| 12 | 550 | 540 |
| 14 | 520 | 650 |
| 24 | 580 | 550 |
| 25 | 540 | 690 |
| 26 | 725 | 840 |
| 27 | 770 | 845 |
| 28 | 635 | — |

TABLE 6

| Coating of ex. | Diamond Indentor $\mu = F_t(N)/5N$ 1st revolution | Steel Indentor $\mu = F_t(N)/5N$ 1st revolution | Steel Indentor $\mu = F_t(N)/5N$ 5th revolution |
|---|---|---|---|
| 12 | 0.20 | 0.23 | 0.30 |
| 14 | 0.18 | 0.13 | 0.15 |
| 24 | 0.12–0.15 | 0.17 | 0.15 |
| 25 | 0.18 | 0.17 | 0.19 |
| 26 | — | 0.15 | 0.16 |
| 27 | | 0.15 | 0.19 |
| 28 | 0.25 | 0,20 | 0.29 |
| Plasma deposit of starting composition of | | | |
| ex. 12 | — | 0.27 | 0.50 |
| ex. 13 | 0.16 | 0.12–0.15 | 0.15–0.18 |

We claim:

1. Flexible wire for thermal deposition comprising a core incorporating an organic binder and a powder or powder mixture, said powder or powder mixture forming a quasi-crystalline alloy upon thermal deposition, said quasi-crystalline alloy having a crystallographic symmetry of rotation that is incompatible with a translation symmetry of said alloy or having a Crystallographic structure compatible with the translation symmetry but having diffraction images in the electron diffraction pattern close to the 5, 8, 10 and 12-fold rotation axes, said core being surrounded by an organic material sheath.

2. Wire according to claim 1, wherein the core also contains an inorganic binder.

3. Wire according to claim 2, wherein the inorganic binder is constituted by alumina fibers.

4. Wire according to claim 1, wherein the powder able to form a quasi-crystalline alloy is an alloy powder of composition:

$$Al_aX_b(B,C)_cM_dN_eI_f$$

in which

X represents at least one element chosen from among Cu and Co,

M represents one or more elements from the group including Fe, Cr, Mn, Ni, Ru, Os, Mo, V, Mg, Zn, Ga and Pd, N represents one or more elements from the group including W, Ti, Zr, Hf, Rh, Nb, Ta, Y, Si, Ge and rare earths, I represents one or more alloy impurities and a, b, c, d, e and f represent atomic percentages such that they satisfy the following relations:

$48 \leqq a < 92$
$0 < b \leqq 30$
$0 \leqq c \leqq 5$
$8 \leqq d \leqq 30$
$0 \leqq e \leqq 4$
$0 \leqq f \leqq 2$
$a+b+c+d+e+f=100$
$b+d+e \leqq 45$.

5. Wire according to claim 1 wherein the powder mixture able to form a quasi-crystalline alloy is a mixture of powders of the elements Al, X, B, C, H, N and I with X representing at least one element chosen from among Cu and Co, M representing one or more elements of the group including Fe, Cr, Hn. Ni, Ru, Os, Mo, V, Mg, Zn, Ga and Pd, N representing one or more elements from the group including W, Ti, Zr, Hf, Rh, Nb, Ta, Y, Si, Ge and the rare earths and I representing one or more alloy impurities, in proportions such that the powder mixture corresponds to the composition of formula:

$$Al_aX_b(B,C)_cM_dN_eI_f$$

in which X, H, N and have the meanings given hereinbefore and a, b, c, d, e and f represent atomic percentages such that they satisfy the following relations:

$48 \leqq a < 92$
$0 < b \leqq 30$
$0 \leqq c \leqq 5$
$8 \leqq d \leqq 30$
$0 \leqq e \leqq 4$
$0 \leqq f \leqq 2$
$a+b+c+d+e+f=100$
$b+d+e \leqq 45$.

6. Wire according to claim 5, wherein at least two elements of the composition are present in the mixture of powders in the form of a combination of these elements.

7. Wire according to claim 1 wherein the sheath and the organic binder are constitute by a cellulose derivative chosen from among methyl cellulose, hydroxymethyl cellulose, hydroxyethyl methyl cellulose and carboxymethyl cellulose.

8. Wire according to claim 1 wherein the core also incorporates water.

9. Flexible wire for thermal deposition coating, comprising a core constituted by a mixture of inorganic powders and an inorganic material sheath, the powders of the mixture and the sheath being constituted by one or more elements chosen from among Al, X, B, C, M, N and I with X representing at least one element chosen from among Cu and Co, M representing one or more elements from the group including Fe, Cr, Hn, Ni, Ru, Os, No, V, Hg, Zn, Ga and Pd, N representing one or more elements from the group including W, Ti, Zr, Hf, Rh, Nb, Ta, Y, Si, Ge and the rare earths and I representing one or more alloy impurities, in proportions such that the combination sheath and powder mixture corresponds to a quasi-crystalline alloy composition.

10. Wire according Lo claim 9, wherein the quasi-crystalline alloy composition is in accordance with the formula:

$$Al_aX_b(B,C)_cM_dN_eI_f$$

in which X, M, N and I have the meanings given hereinbefore and a, b, c, d, e and f represent atomic percentages so as to satisfy the following relations:

$48 \leqq a < 92$
$0 < b \leqq 30$
$0 \leqq c \leqq 5$
$8 \leqq d \leqq 30$ $0 \leqq e \leqq 4$ $0 \leqq f \leqq 2$ $a+b+c+d+e+f=100$ $b+d+e \leqq 45$.

11. Wire according to claim 10, wherein the sheath is made from steel, aluminium, copper or nickel.

12. Wire according to claim 1, wherein the core also incorporates an organic plasticizer.

13. Wire according to claim 13, wherein the core also incorporates water.

* * * * *

UNITED STATES PATENT AND TRADEMARK OFFICE
CERTIFICATE OF CORRECTION

PATENT NO. : 5,424,127

DATED : June 13, 1995

INVENTOR(S) : Jean-Marie Dubois et al.

It is certified that error appears in the above-identified patent and that said Letters Patent is hereby corrected as shown below:

In the Abstract, Section [57], line 2, delete "For" and insert --for--.

In the Abstract, Section [57], line 5, delete "Form" and insert --form--.

Column 1, line 6, delete "present-invention" and insert --present invention--.

Column 1, line 11, delete "ace"and insert --are--.

Column 1, line 15, after "following" insert a colon -- : --.

Column 1, line 21, delete "m3 5" and insert --$m\bar{3}\bar{5}$--.

Column 1, line 26, delete "10/mm" and insert --10/mmm--.

Column 1, line 27, delete "Syrrmetry" and insert --Symmetry--.

UNITED STATES PATENT AND TRADEMARK OFFICE

CERTIFICATE OF CORRECTION

PATENT NO. : 5,424,127

DATED : June 13 1995

INVENTOR(S) : Jean-Marie Dubois et al.

It is certified that error appears in the above-identified patent and that said Letters Patent is hereby corrected as shown below:

Column 1, line 32, delete "Janat" and insert --Janst--.

Column 1, line 32, delete "Pannerlet" and insert --Pannetier--.

Column 1, line 32, delete "Planelli" and insert --Pianelli--.

Column 1, line 51, delete "36°" and insert --36°--.

Column 1, line 56, delete "H.V." and insert --M.V.--.

Column 1, line 64, delete "tile" and insert --the--.

Column 2, line 7, delete "Cs-cl" and insert —Cs–Cl—.

Column 2, line 8, delete "a=" and insert --a1--.

Column 2, line 10, delete "J.H." and insert --J.M.--.

Column 2, line 25, before "formula" insert --namely--.

UNITED STATES PATENT AND TRADEMARK OFFICE
CERTIFICATE OF CORRECTION

PATENT NO. : 5,424,127

DATED : June 13, 1995

INVENTOR(S) : Jean-Marie Dubois et al.

It is certified that error appears in the above-identified patent and that said Letters Patent is hereby corrected as shown below:

Column 2, line 37, delete "(21960) and insert --(1960)--.

Column 3, line 15, delete "of" and insert --or--.

Column 3, line 46, after "e.g." delete "with specific properties makincalcination" and insert —by evaporation and/or calcination—.

Column 3, line 48, delete "ethglycol" and insert --ethylene glycol--.

Column 3, line 57, delete "$AL_aX_0(BC)_cM_dN_eI_f$" and insert --$AL_aX_0(BC)_cM_dN_eI_f$--.

Column 4, line 11, delete "b+d+3≤45" and insert —~~b+d+e~~ 45—.

Column 4, line 22, delete "Lo" and insert --to--.

Column 4, line 23, delete "Lo" and insert --to--.

Column 4, line 28. "g" should be "Mg--.

UNITED STATES PATENT AND TRADEMARK OFFICE
CERTIFICATE OF CORRECTION

PATENT NO. : 5,424,127

DATED : June 13, 1995

INVENTOR(S) : Jean-Marie Dubois et al.

It is certified that error appears in the above-identified patent and that said Letters Patent is hereby corrected as shown below:

Column 4, line 66, delete "449" and insert --443--.

Column 5, line 4, delete "M." and insert --M.--.

Column 5, line 7, delete "Hn" and insert --Mn--.

Column 5, line 7, delete "Ho" and insert --Mo--.

Column 5, line 16, delete "H" and insert --M--.

Column 5, line 19, delete "steel." and insert --steel,--.

Column 5, line 41, delete "fibers." and insert --fibers,--.

Column 5, line 44, delete ".and" and insert --and--.

Column 5, line 59, delete ".by" and insert --by--.

Column 6, line 67, delete "8" and insert --a--.

UNITED STATES PATENT AND TRADEMARK OFFICE
CERTIFICATE OF CORRECTION

PATENT NO. : 5,424,127 Page 5 of 7

DATED : June 13, 1995

INVENTOR(S) : Jean-Marie Dubois et al.

It is certified that error appears in the above-identified patent and that said Letters Patent is hereby corrected as shown below:

Column 7, line 15, delete "8" and insert --a--.

Column 7, line 56, after "of" insert --a--.

Column 7, line 68, after "of" insert —4.8 mm.—

Column 8, line 44, after "patterns" insert --of--.

Column 8, line 46, delete "(FIG. 6) and insert --(FIG. 6),--.

Column 8, line 59, delete "figs, and insert --FIGS.--.

Column 9, line 10, delete "1/33 5" and insert --1 x 5--.

Column 10, line 13, "p," should be --$\mu$,--.

Column 10, line 18, delete "pin/dis" and insert --pin/disk--.

Column 10, line 35, delete "f" and insert --$F_t$--.

UNITED STATES PATENT AND TRADEMARK OFFICE
CERTIFICATE OF CORRECTION

PATENT NO. : 5,424,127

DATED : June 13, 1995

INVENTOR(S) : Jean-Marie Dubois et al.

It is certified that error appears in the above-identified patent and that said Letters Patent is hereby corrected as shown below:

Column 11, line 14, delete "$5.10^{-6}$s" and insert --$5 \bullet 10^{-6}$s--.

Column 12,

At Table 3, line 13. insert --FIG. 7-- at the end of the line.

Column 11, line 52, delete "SETARAH" and insert --SETARAM--.

Column 13, line 37, delete "Crystallo-" and insert --crystallo- --.

Column 14, line 7, delete "H" and insert --M--.

Column 14, line 10, delete "Hn." and insert --Mn,--.

Column 14 line 20, delete "H" and insert --M--.

Column 14, line 20, after "and" insert --I--.

Column 14, line 49, delete "Hn" and insert --Mn--.

UNITED STATES PATENT AND TRADEMARK OFFICE

CERTIFICATE OF CORRECTION

PATENT NO. : 5,424,127

DATED : June 13, 1995

INVENTOR(S) : Jean-Marie Dubois et al.

It is certified that error appears in the above-identified patent and that said Letters Patent is hereby corrected as shown below:

Column 14, line 50, delete "No" and insert --Mo--.

Column 14, line 50, delete "Hg" and insert --Mg--.

Column 14, line 56, delete "Lo" and insert -to--.

Signed and Sealed this

Tenth Day of October, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,424,127
DATED : June 13, 1995
INVENTOR(S) : Jean-Marie Dubois et al.

It is certified that error appears in the above-indentified patent and that said Letters Patent is hereby corrected as shown below:

On the title page, Section [73], the following assignees should be inserted: --Centre National De La Recherche Scientifique, Paris, France; and Societe Nouvelle De Metallisation Industries (SNMI) Cedex, France--.

Signed and Sealed this

Eighteenth Day of March, 1997

*Attest:*

*Attesting Officer*

BRUCE LEHMAN

*Commissioner of Patents and Trademarks*